US008611775B2

(12) United States Patent
Udagawa et al.

(10) Patent No.: US 8,611,775 B2
(45) Date of Patent: Dec. 17, 2013

(54) IMAGE FORMING APPARATUS COMPRISING A FIXING PRESSURE SWITCHING UNIT AND MEDIUM STORING IMAGE FORMING PROGRAMS THEREIN

(75) Inventors: Hirotaka Udagawa, Kanagawa (JP); Shinya Watanabe, Kanagawa (JP); Tetsuya Sonoda, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 117 days.

(21) Appl. No.: 13/117,714

(22) Filed: May 27, 2011

(65) Prior Publication Data

US 2012/0107000 A1 May 3, 2012

(30) Foreign Application Priority Data

Nov. 2, 2010 (JP) ..... 2010-246139

(51) Int. Cl.
*G03G 15/20* (2006.01)
*G03G 15/00* (2006.01)

(52) U.S. Cl.
USPC ..... 399/67; 399/45

(58) Field of Classification Search
USPC ..... 399/67, 45, 82, 328; 219/216
See application file for complete search history.

(56) References Cited

U.S. PATENT DOCUMENTS

2007/0025750 A1* 2/2007 Ando ..... 399/67
2009/0060541 A1* 3/2009 Takeuchi ..... 399/45

FOREIGN PATENT DOCUMENTS

JP 10-333386 A 12/1998
JP 2008-058365 A 3/2008

* cited by examiner

*Primary Examiner* — Billy J Lactaoen
(74) *Attorney, Agent, or Firm* — Sughrue Mion, PLLC

(57) ABSTRACT

There is provided an image forming apparatus including: a forming unit that forms a toner image according to image information for an image to be formed on a sheet; a fixing unit that fixes the toner image formed on the sheet; a switching unit that switches a fixing pressure of the fixing unit by an operation; a stopping unit that, when the fixing pressure is switched to fix at a second fixing pressure lower than a predefined first fixing pressure, stops conveying a final sheet before the final sheet is fed after being fixed; and an instructing unit that, when the stopping unit stops conveying the final sheet, instructs switching to the first fixing pressure.

7 Claims, 6 Drawing Sheets

IMAGE FORMING APPARATUS COMPRISING A FIXING PRESSURE SWITCHING UNIT AND MEDIUM STORING IMAGE FORMING PROGRAMS THEREIN

CROSS-REFERENCE TO RELATED APPLICATION

This application is based on and claims priority under 35 USC 119 from Japanese Patent Application No. 2010-246139 filed on Nov. 2, 2010.

BACKGROUND

Technical Field

The invention relates to an image forming apparatus and a medium storing image forming programs therein.

SUMMARY

According to an aspect of the invention, there is provided an image forming apparatus including:

a forming unit that forms a toner image according to image information for an image to be formed on a sheet;

a fixing unit that fixes the toner image formed on the sheet;

a switching unit that switches a fixing pressure of the fixing unit by an operation;

a stopping unit that, when the fixing pressure is switched to fix at a second fixing pressure lower than a predefined first fixing pressure, stops conveying a final sheet before the final sheet is fed after being fixed; and an instructing unit that, when the stopping unit stops conveying the final sheet, instructs switching to the first fixing pressure.

BRIEF DESCRIPTION OF THE DRAWINGS

Exemplary embodiments of the invention will be described in detail based on the following figures, wherein.

DETAILED DESCRIPTION

An exemplary embodiment according to the invention will be described below.

Figure 1:
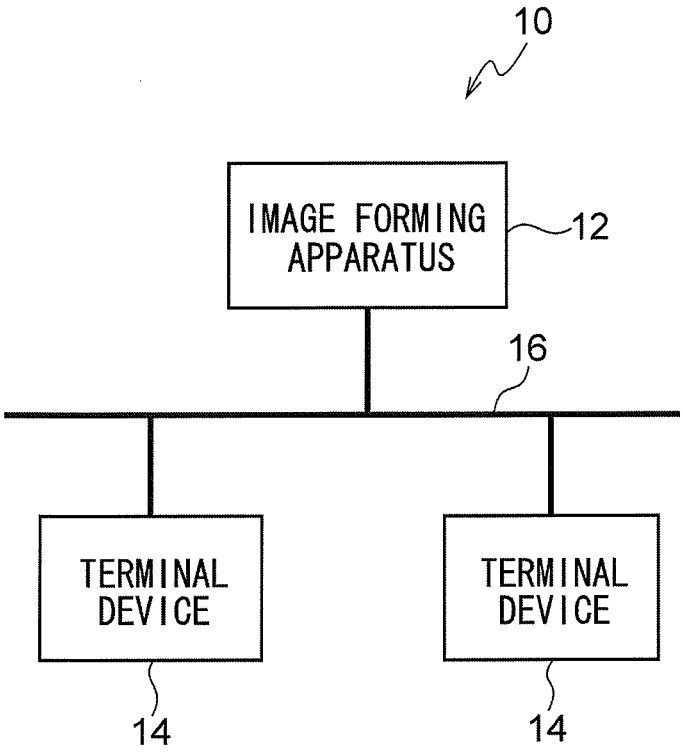
FIG. 1 is a schematic structure diagram of an image forming system.

FIG. 1 exemplarily illustrates a schematic structure of an image forming system 10 according to the exemplary embodiment. As shown in FIG. 1, the image forming system 10 is configured such that an image forming apparatus 12 and terminal devices 14 are interconnected via a network 16.

Figure 2:
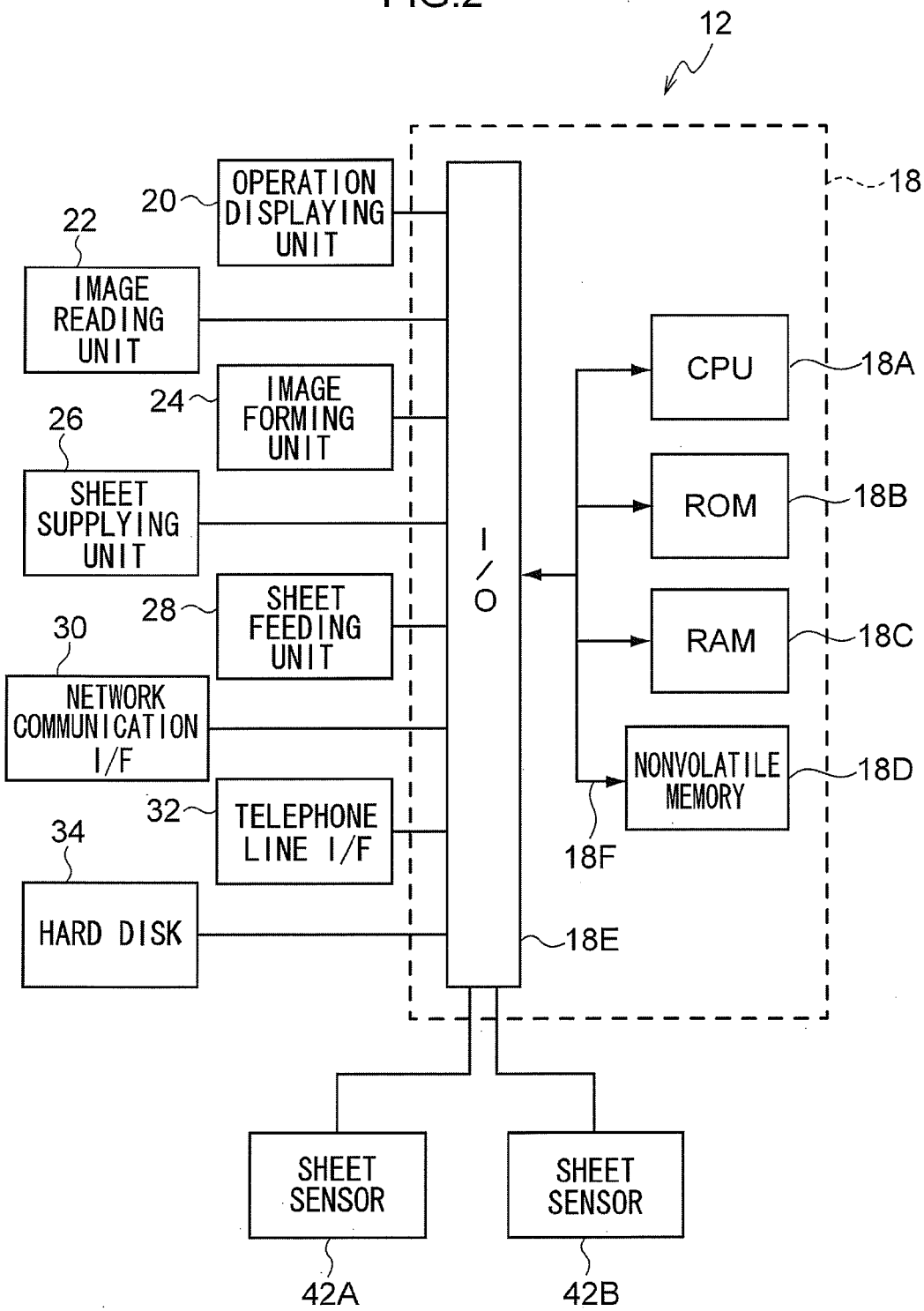
FIG. 2 is a schematic structure diagram of an image forming apparatus.

FIG. 2 exemplarily illustrates a schematic structure of the image forming apparatus 12. As shown in FIG. 1, the image forming apparatus 12 includes a computer 18 (as a controlling unit).

The computer 18 is configured such that a CPU (Central Processing Unit) 18A, a ROM (Read Only Memory) 18B, a RAM (Random Access Memory) 18C, a nonvolatile memory 18D and an input/output interface (I/O) 18E are interconnected via a bus 18F.

The I/O 18E is connected with the respective function units such as an operation displaying unit 20, an image reading unit 22, an image forming unit 24, a sheet supplying unit 26, a sheet feeding unit 28, a network communication interface (I/F) 30, a telephone line interface (I/F) 32 and a hard disk 34 (as a storing unit).

The operation displaying unit 20 includes various buttons such as a start button or numerical keys for instructing to start copying, a setting screen for setting parameters of various image forming conditions such as copy density, and a touch panel for displaying various screens of device statuses and others thereon.

The image reading unit 22 includes an image reading sensor such as line CCD, or a scanning mechanism for scanning the image reading sensor, and is directed for reading an image of a document set in the device.

The image forming unit 24 is directed for forming an image on a recording medium by a so-called electrophotographic system, for example. Specifically, the image forming unit 24 includes a charging device for charging a photosensitive drum, an exposing device for exposing the charged photosensitive drum by a light according to an image and thereby forming an electrostatic latent image according to the image on the photosensitive drum, a developing device for developing the electrostatic latent image formed on the photosensitive drum by toners, a transferring device for transferring the toner image according to the image formed on the photosensitive drum onto a recording medium, and a fixing device 36 (as a fixing unit) for fixing the toner image according to the image transferred onto the recording medium as shown in FIG. 3.

The exposing device may be an optical scanner including an optical system such as semiconductor laser, rotating polygon mirror, collimator lens, cylindrical lens or fθ lens, or a LED head including plural LEDs.

Figure 3:
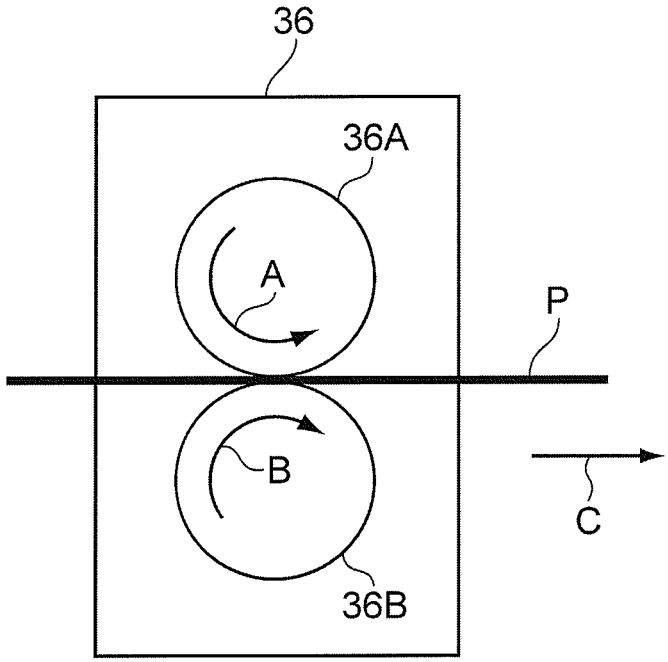
FIG. 3 is a schematic structure diagram of a fixing device.

As shown in FIG. 3, the fixing device 36 includes, as an example, a heater such as halogen lamp inside a metallic core having a high thermal conductivity, and includes a heating roll 36A for rotating in the arrow A direction in the Figure, and a pressurizing roll 36B arranged opposite to the heating roll 36A for rotating in the arrow B direction in the figure. A sheet P on which the toner image according to the image is formed is sandwiched between the heating roll 36A rotating in the arrow A direction in the Figure and the pressurizing roll 36B rotating in the arrow B direction in the Figure to be conveyed in the arrow C direction. Thus, the toner image formed on the sheet P is heated and fixed.

The fixing device 36 is configured such that a fixing pressure when the toner image is fixed on the sheet P, that is, a pressure when the pressurizing roll 36B pressurizes the heating roll 36A is switched to either the first fixing pressure or the second fixing pressure. The first fixing pressure is suitable for fixing the toner image formed on a typically-used sheet such as plain paper, and the second fixing pressure is suitable for fixing the toner image formed on an envelope on which wrinkles can more easily occur than plain paper when being fixed at the first fixing pressure, and is lower than the first fixing pressure. In the exemplary embodiment, as an example, a pressure for fixing a sheet such as plain paper, except for envelope, is called the first fixing pressure, a fixing mode for fixing at the first fixing pressure is called the normal mode, a pressure for fixing an envelope is called the second fixing pressure, and a fixing mode for fixing at the second fixing pressure is called the envelope mode.

Figure 4A:
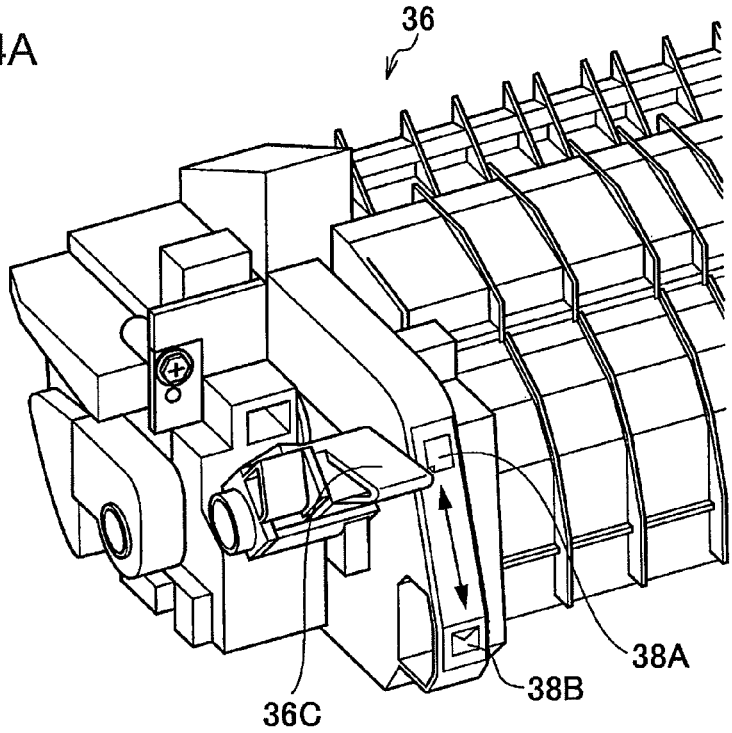
FIG. 4A is a perspective view showing part of the outer shape of the fixing device in the normal mode.
Figure 4B:
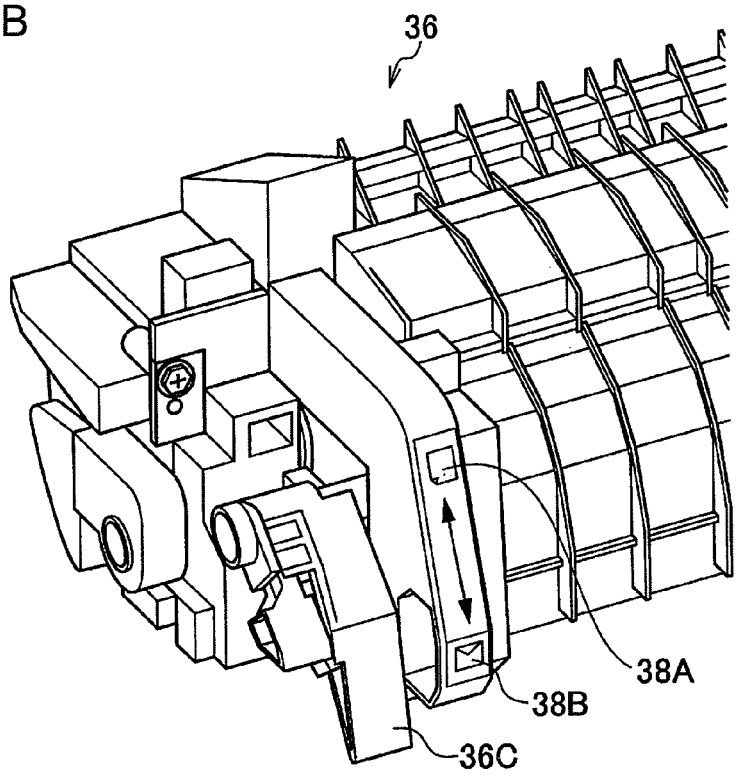
FIG. 4B is a perspective view showing part of the outer shape of the fixing device in the envelope mode.

FIGS. 4A and 4B are perspective views of part of the outer shape of the fixing device 36. As shown in FIG. 4A, the fixing device 36 includes a switching lever 36C (as a switching unit) for switching the fixing pressure. When the switching lever 36C is at the mark 38A indicating plain paper, it is switched to the normal mode, i.e., switched to a mode to conduct fixing at the first fixing pressure. On the other hand, as shown in FIG. 4B, when the switching lever 36C is at the mark 38B indicating envelope, it is switched to the envelope mode, i.e., switched to a mode to conduct fixing at the second fixing pressure lower than the first fixing pressure.

As described above, the fixing device 36 is configured such that the pressure at which the pressurizing roll 36B pressurizes the heating roll 36A is switched along with the switching operation by the user of the switching lever 36C. The position of the switching lever 36C is detected by a sensor (not shown), and information indication where the switching lever 36C is present is stored in a memory (not shown) inside the image forming unit 24, for example. The CPU 18A inquires at the image forming unit 24 about the information indicating where the switching lever 36C is present, and thereby acquires the information on where the switching lever 36 is currently present.

When the user wants to make prints on an envelope, the user switches the switching lever 36C to the envelope mode, and when the user wants to make prints on a sheet such as plain paper, switches the switching lever 36C to the normal mode. Then, the user instructs the printing from the terminal device 14 or operates the operation displaying unit 20 to instruct the copying. Thereby the toner image is fixed at a fixing pressure suitable for a respective sheet.

Figure 5:
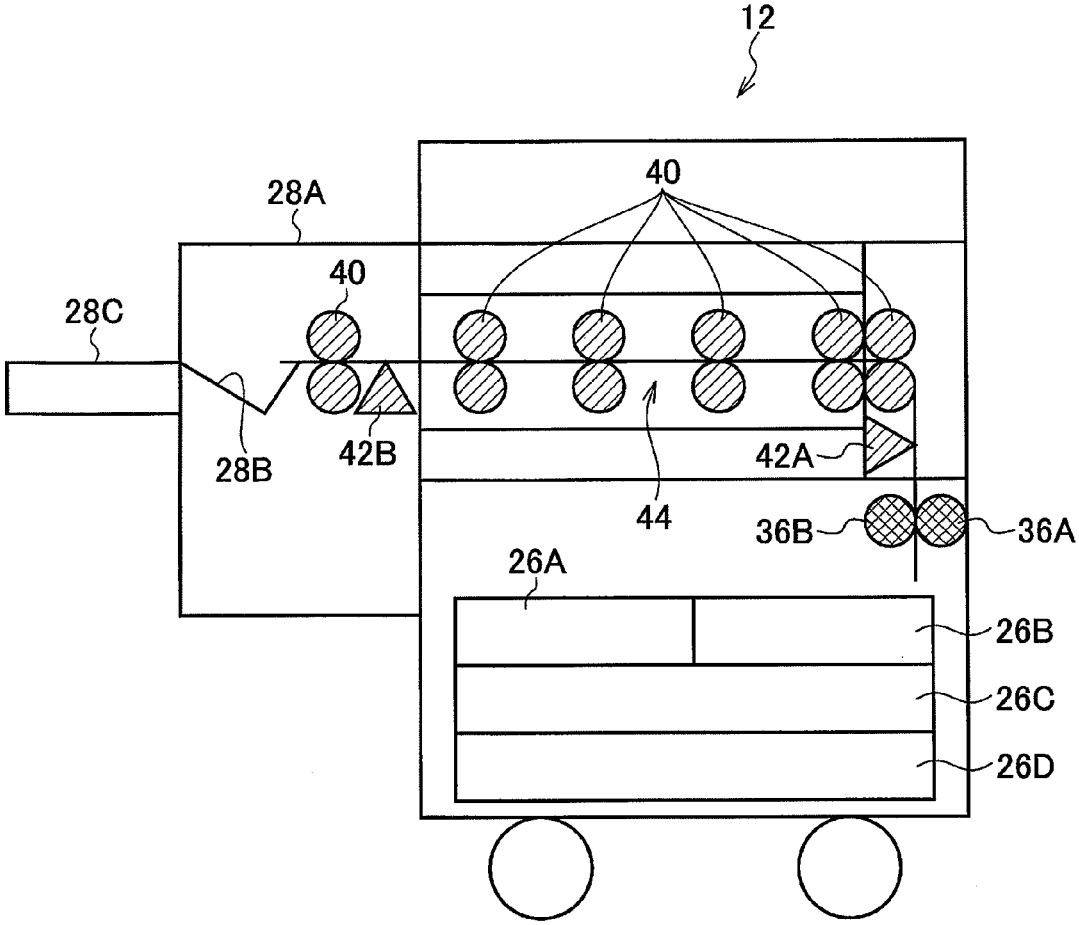
FIG. 5 is a diagram for explaining a conveying path in the image forming apparatus.

The sheet supplying unit 26 includes sheet housing units in which recording sheets are housed, or a supplying mechanism for supplying the recording sheets from the sheet housing unit to the image forming unit 24. The sheet housing units include plural housing units 26A to 26D such as a housing unit for housing plain paper and a housing unit for housing envelopes as shown in FIG. 5.

The sheet feeding unit 28 includes a finisher for performing post-processings such as staple processing or punch processing on the recording sheets, a feeding unit from which the recording sheets are fed, and a feeding mechanism for feeding the recording sheets on which the image is formed by the image forming unit 24 onto the finisher or the feeding unit. In the exemplary embodiment, as shown in FIG. 5, there will be described a case in which the sheet feeding unit 28 includes the finisher 28A, but the finisher 28A may not be provided.

The conveying of the sheets will be described herein. When a sheet is extracted from the housing unit in which the designated sheets are housed among the plural housing units 26A to 26D, the toner image according to the image is formed on the extracted sheet and fixed by the fixing device 36. The sheet on which the toner image is fixed by the fixing device 36 is conveyed by a conveying roller 40 toward the finisher 28A. When the post-processing such as staple processing is instructed, the conveyed sheet is temporarily fed to a primary sheet tray 28B and subjected to the post-processing such as staple processing to be fed to a sheet tray 28C.

A sheet sensor 42A for detecting a sheet is provided on the downstream of the conveying direction of the fixing device 36. A sheet sensor 42B is provided at the sheet take-in side of the finisher 28A. The sheet sensors 42A and 42B are connected to the I/O 18E as shown in FIG. 2.

The network communication I/F 30 is an interface for making data communication with the terminal devices 14 via the network 16.

The telephone line communication I/F 32 is directed for making facsimile communication with other image forming devices connected via a telephone line (not shown).

The hard disk 34 stores therein log data such as states or operating statuses of the respective units of the devices, log data on the processing results of copying, facsimile communication and printing, various items of setting data, and control programs.

The control programs of the processings described later are previously stored in the hard disk 34 as one example in the exemplary embodiment, and the previously-stored control programs are read by the CPU 18A to be executed. The control programs may be recorded in a recording medium such as CD-ROM and read by a CD-ROM drive to be executed.

The terminal device 14 is configured of a typical personal computer, for example, and when the user instructs to print, transmits the image forming information including the image information on the image to be formed on the sheet and the sheet information on a sheet type to the image forming apparatus 12. The sheet information is directed for designating a type of sheet such as plain paper or envelope in the exemplary embodiment. The "images" in the exemplary embodiment include images in various forms such as an image containing only characters and an image containing photographs or graphics.

When the user wants to print address and others on an envelope, for example, the user switches the switching lever 36C to the envelope mode, and when the user wants to print on other sheet such as plain paper, switches the switching lever 36C to the normal mode. The user designates the envelope or the plain paper as the sheet information from the terminal device 14 and transmits the sheet information together with the image information to the image forming apparatus 12 via the network 16 to instruct the printing.

When receiving the image forming information containing the image information and the sheet information transmitted from the terminal device 14 via the network 16, the image forming apparatus 12 forms an image on the designated sheet based on the received image forming information.

When receiving the image forming information from other device via the telephone line in the facsimile communication, the image forming apparatus 12 forms an image on the designated sheet based on the received image forming information.

When the user sets the document in the image reading unit 22 and operates the operation displaying unit 20 to designate a type of the sheet, the image forming apparatus 12 forms an image of the document read by the image reading unit 22 on the designated sheet.

Figure 6:
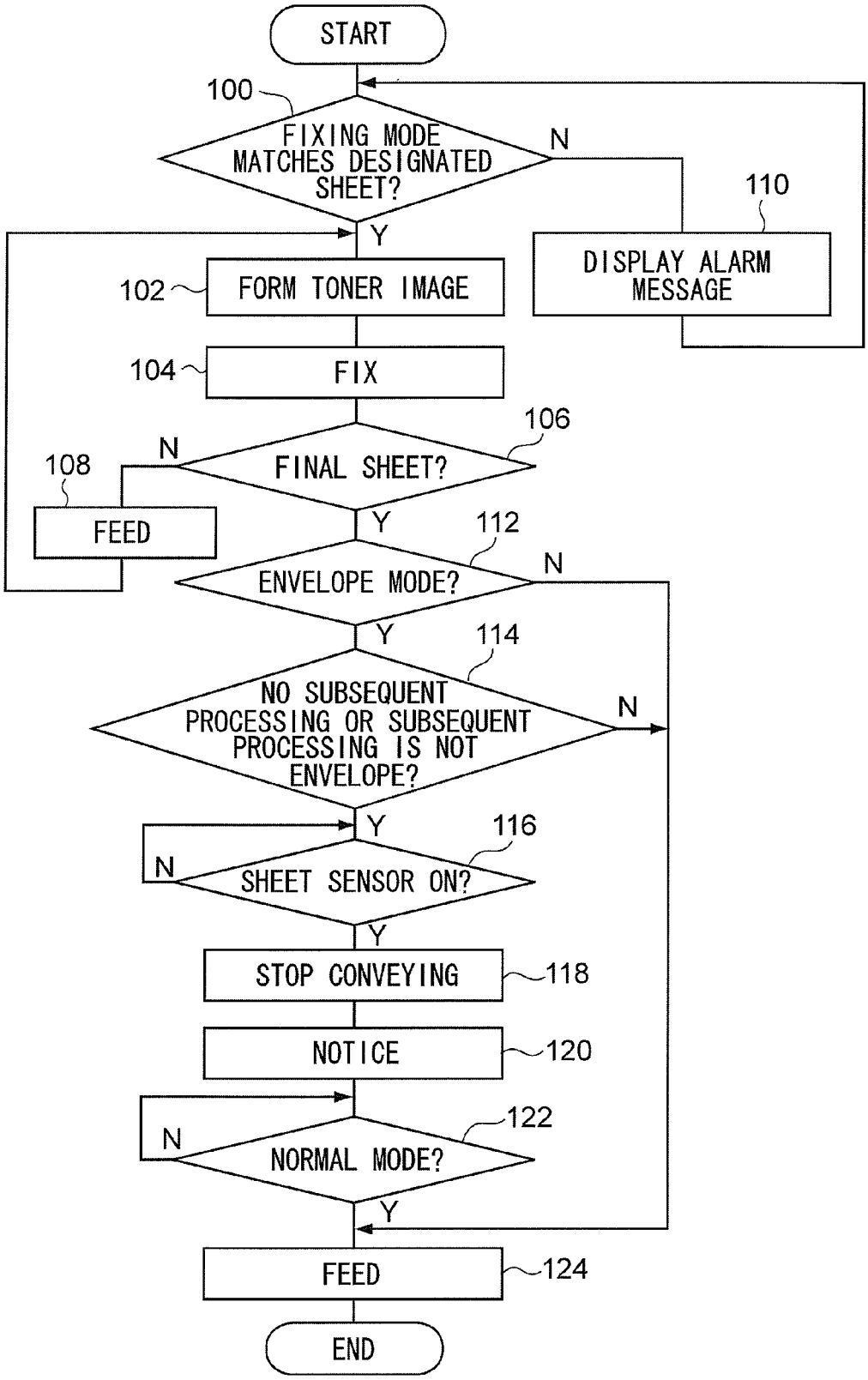
FIG. 6 is a flowchart of processing to be performed in the image forming apparatus.

The processings executed by the CPU 18A of the image forming apparatus 12 as the operation of the exemplary embodiment will be described below with reference to the flowchart of FIG. 6.

The processings are performed when the user sets the document in the image reading unit 22 to instruct the copying or when the image forming information is received from the terminal device 14 via the network 16.

At first, in step 100, a decision is made as to whether a sheet corresponding to a current fixing mode and a sheet designated by the sheet information match each other. Specifically, the information indicating where the switching lever 36C is present is acquired from the image forming unit 24 and a decision is made based on the information as to whether the current fixing mode is the normal mode or the envelope mode. Then, a decision is made as to whether the sheet corresponding to the fixing mode and the sheet designated by the sheet information match each other.

When the sheet corresponding to the current fixing mode and the sheet designated by the sheet information match each other, the processing proceeds to step 102, and when they do not match, the processing proceeds to step 110.

In step 110, since the sheet corresponding to the current fixing mode and the sheet designated by the sheet information do not match each other, an alarm message promoting to switch the switching lever 36C is displayed on the operation displaying unit 20. When the printing is instructed from the terminal device 14, the terminal device 14 may be instructed to display the alarm message.

On the other hand, in step 102, since the sheet corresponding to the current fixing mode and the sheet designated by the sheet information match each other, the image forming unit 24 is instructed to form the toner image according to the image for one sheet on the designated sheet. Thus, the toner image according to the image is formed on the sheet.

In step 104, the fixing device 36 is instructed to fix the toner image formed on the sheet. Thus, the toner image formed on the sheet is fixed.

In step 106, a decision is made as to whether the sheet is the final, when the sheet is the final, the processing proceeds to step 112, and when the sheet is not the final, the processing proceeds to step 108.

In step 108, the sheet on which the toner image is fixed is conveyed by the conveying roller 40 toward the finisher 28A and is subjected to the post-processings by the finisher 28A as needed to be fed to the sheet tray 28C. The steps 102 to 108 are repeated until the fixing on the final sheet is completed.

In step 112, a decision is made as to whether the current fixing mode is the envelope mode. Then, when the current fixing mode is the envelope mode, the processing proceeds to step 114, and when the current fixing mode is not the envelope mode, that is, in the normal mode, the processing proceeds to step 124.

In step 114, a decision is made as to whether subsequent image forming is designated, and when the subsequent image forming is designated, a decision is made as to whether the designated sheet is other than the envelope. When the subsequent image forming is not designated or when the subsequent image forming is designated but the designated sheet is other than the envelope, the processing proceeds to step 116, and when the subsequent image forming is designated but the designated sheet is the envelope, the processing proceeds to step 124.

In step 116, a decision is made as to whether the sheet sensor 42A has been turned on, when the sheet sensor 42A has been turned on, the processing proceeds to step 118, and when the sheet sensor 42A has not been turned on, the processing waits until the sheet sensor 42A is turned on.

In step 118, the final sheet stops being conveyed. At this time, the conveying of the final sheet can be stopped when a second predefined time elapsed since the sheet sensor 42A was being turned on for the first time and then off. The first time is set when it can be decided that the final sheet can be accurately detected if the sheet sensor 42A is being turned on for more than the first time. In other words, if it is decided that the final sheet has been detected also when the sheet sensor 42A is turned on for just a moment, it is erroneously decided that the final sheet has been detected also when the sheet sensor 42A is turned on for just a moment due to an influence such as noise. For preventing the erroneous decision, it is decided that the final sheet is detected when the on-state continues for the first time and then the sheet sensor 42A is turned off.

The second time is set when the conveying of the final sheet is stopped after the time passed where it is possible to prevent the final sheet from being damaged, being bent or being curled.

For example, in FIG. 5, the second time is set when the final sheet can be stopped to be upright on the flat conveying path 44 where the final sheet can be stopped without being bent. In other words, the second time is set at a time until the tail of final sheet is conveyed onto the flat conveying path 44 after the final sheet is fixed by the fixing device 36 and detected by the sheet sensor 42A.

When the finisher 28A is designated as the feeding destination of the sheet and any post-processing is designated to perform, the image-formed sheet before the final sheet may be fed onto the primary sheet tray 28B of the finisher 28A to stop the final sheet on the conveying path 44. In the image forming instruction for one sheet, the sheet may be stopped on the conveying path 44, or may be fed onto the primary sheet tray 28B and fed onto the sheet tray 28C after the switching lever 36C is switched to the normal mode.

In step 120, the alarm message promoting the user to return the fixing mode to the normal mode such as "return the fixing mode to the normal mode" is displayed on the operation displaying unit 20 to notify that the switching lever 36C should be operated to return the fixing mode to the normal mode. When the printing is instructed from the terminal device 14, the terminal device 14 may be instructed to display the alarm message.

In step 122, a decision is made as to whether the switching lever 36C has been switched to the normal mode, when the switching lever has been returned to the normal mode, the processing proceeds to step 124, and when the switching lever has not been returned to the normal mode, the processing waits until the fixing mode is returned to the normal mode.

In step 124, the final sheet restarts being conveyed, is conveyed toward the finisher 28A, and is subjected to the post-processings by the finisher 28A as needed to be fed to the sheet tray 28C.

As described above, in the exemplary embodiment, when the fixing mode is the envelope mode, even when the fixing of the toner image onto the final sheet is completed, the final sheet is not immediately fed to the sheet tray 28A and stops being conveyed to instruct the switching lever 36C to return to the normal mode. Thus, the user recognizes that the fixing mode needs to be returned to the normal mode, and performs the operation of returning the switching lever 36C to the normal mode.

In the exemplary embodiment, there has been described the case in which the final sheet restarts being conveyed and is fed when the switching lever 36 is returned to the normal mode after the final sheet is fixed and stops being conveyed in the envelope mode, but the exemplary embodiment is not limited thereto, and when the user performs an operation of erasing the alarm message displayed on the operation displaying unit 20, that is, when the user performs an operation by which it is decided that the alarm message is recognized by the user, the final sheet may restart being conveyed and may be fed.

In the exemplary embodiment, there has been described the case in which the fixing mode is switched to either the normal mode or the envelope mode, but the exemplary embodiment may be configured such that the fixing mode is switched to any of more than two modes.

The structure of the image forming apparatus 12 described in the above exemplary embodiment (see FIG. 2) is exemplary, and unnecessary parts may be deleted or new parts may be added within the scope without departing from the spirit of the invention.

The flow of the control program processings described in the above exemplary embodiment (see FIG. 6) is exemplary, and unnecessary steps may be deleted or new steps may be added within the scope without departing from the spirit of the invention, or the order of processings may be rearranged.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a forming unit that forms a toner image according to image information for an image to be formed on a sheet;

a fixing unit that fixes the toner image formed on the sheet;

a switching unit that switches a fixing pressure of the fixing unit;

a stopping unit that, when the fixing pressure is switched to fix at a second fixing pressure lower than a predefined first fixing pressure, stops conveying a final sheet before the final sheet is fed to a sheet tray after being fixed; and an instructing unit that, when the stopping unit stops conveying the final sheet, instructs switching to the first fixing pressure.

2. The image forming apparatus according to claim 1, wherein the stopping unit stops conveying the final sheet at a position at which the final sheet can stop without being bent.

3. The image forming apparatus according to claim 1, wherein when subsequent image forming is not instructed or when subsequent image forming is instructed and a designated sheet is to be fixed at the first fixing pressure, the stopping unit stops conveying the final sheet.

4. The image forming apparatus according to claim 1, further comprising:

a feeding unit that feeds the final sheet to the sheet tray when the fixing pressure is switched to the first fixing pressure in response to the instruction by the instructing unit.

5. A non-transitory computer-readable storage medium having stored therein an image forming program for causing a computer to control the respective units constituting the image forming apparatus according to claim 1.

6. The image forming apparatus according to claim 2, wherein the conveyance of the final sheet is stopped on a flat conveying path after the final sheet is fixed by the fixing unit.

7. The image forming apparatus according to claim 1, wherein the final sheet is an envelope.

* * * * *